US007779503B2

(12) United States Patent
Dale et al.

(10) Patent No.: US 7,779,503 B2
(45) Date of Patent: Aug. 24, 2010

(54) QUICK RELEASE PAINT ROLLER

(75) Inventors: James C. Dale, Taylorsville, NC (US); Michael M. Sherman, Mooresville, NC (US); Scott A. Pyle, Vernon Hills, IL (US)

(73) Assignee: Zibra, LLC, Mooresville, NC (US)

( * ) Notice: Subject to any disclaimer, the term of this patent is extended or adjusted under 35 U.S.C. 154(b) by 474 days.

(21) Appl. No.: 11/998,046

(22) Filed: Nov. 28, 2007

(65) Prior Publication Data

US 2009/0133207 A1 May 28, 2009

(51) Int. Cl.
*B05C 17/02* (2006.01)

(52) U.S. Cl. ..... 15/230.11; 492/13; 492/19

(58) Field of Classification Search ..... 15/230.11; 492/13, 19

See application file for complete search history.

(56) References Cited

U.S. PATENT DOCUMENTS 3,060,555 A 10/1962 Kirshenbaum et al.
3,906,581 A 9/1975 Marino et al.
5,509,165 A * 4/1996 Zigelboim et al. ..... 15/230.11
6,519,800 B2 2/2003 Newman et al.
6,681,438 B2 1/2004 Newman et al.
6,941,609 B2 9/2005 Woodruff et al.
2006/0130261 A1 6/2006 Futo et al.
2006/0130262 A1 6/2006 Visk et al.

FOREIGN PATENT DOCUMENTS

DE 196 08941 A1 9/1997

* cited by examiner

*Primary Examiner*—Monica S Carter
*Assistant Examiner*—Stephanie Newton
(74) *Attorney, Agent, or Firm*—Wegman, Hessler & Vanderburg

(57) ABSTRACT

A quick-release paint roller having a roller cover that can be removed from a frame without requiring the user to apply a force directly to the roller cover. The frame includes a pair of arms having base portions received in a hand grip. The arms diverge outwardly to form a Y-shaped frame, wherein distal ends of the arms have mounting cones configured to receive opposing ends of the tube-shaped roller cover in a rotatable manner with respect to the frame. The paint roller has a roller capture mechanism that pivots the arms between a roller-capture position in which the roller cover is captured between the arms and a roller-release position in which the roller cover is decoupled from the arms. A roller-release button is configured to actuate the capture mechanism to pivot the arms between their roller-capture positions and their roller-release positions.

12 Claims, 4 Drawing Sheets

QUICK RELEASE PAINT ROLLER

BACKGROUND OF THE INVENTION

1. Field of Invention

This invention relates to a roller assembly for use in applying a coating to a surface, and more particularly, to a paint roller assembly.

2. Description of Related Art

It is known to use paint roller assemblies having a hand grip 16 with a roller support and a rotatable roller cover to apply paint to a wall. Normally, the roller cover is removably mounted on the roller support so that the roller cover can be detached from the support after use and cleaned or replaced as desired. Additionally, the useful life of the roller cover is often quite limited when compared to that of the hand grip 16 and roller support. As such, the roller cover is usually removed from the hand grip 16 after each use.

Typically, roller covers are frictionally secured to the roller support. One disadvantage associated with this type of roller assembly is that in order to remove the roller cover from the roller support, it is usually necessary to grasp the outer surface of the roller cover and slide it off of the roller support. As the roller cover being removed is normally covered with wet paint, the process of removing the roller cover from the roller assembly can be messy and often leads to paint getting on the hands and clothes of the person removing the roller cover. If one waits until the paint on the roller cover dries before removing the cover, the paint between the roller cover and the roller support dries and seals the roller cover to the roller support. Thus, in order to remove the roller cover from the paint roller assembly it is sometimes necessary to break the dried paint away from the end caps of the roller support, thereby allowing the roller cover to be removed from the roller assembly. Alternatively, it may be necessary to slice, or cut the roller cover along a length thereof, allowing the roller cover to be peeled away from the roller assembly.

Based on the foregoing, it would be desirable to provide a paint roller assembly with a roller cover that can be removed quickly and easily without having to grasp or touch the paint-covered roller cover.

SUMMARY OF INVENTIVE FEATURES

One aspect of the invention is directed to a quick-release paint roller that permits a roller cover to be removed from the frame without requiring the user to apply a manual force directly to the roller cover. The paint roller includes a roller frame that receives the tube-shaped roller cover. The frame has a pair of arms with base portions received in a hand grip. The arms diverge outwardly to form a Y-shaped frame, wherein distal ends of the arms have mounting cones configured to receive opposing ends of the tube-shaped roller cover in a rotatable manner with respect to the frame. The paint roller has a roller capture mechanism that pivots the arms between a roller-capture position in which the roller cover is captured between the arms and a roller-release position in which the roller cover is decoupled from the arms. A roller-release button is configured to actuate the capture mechanism to pivot the arms between their roller-capture positions and their roller-release positions.

In one embodiment, the capture mechanism has a pivoting first link and a pivoting second link. The roller release button is connected to the second link. The first and second links are positioned in an overlapping manner and are connected with a connecting rod such that pivoting the second link with the roller-release button also causes the first link to pivot. A spring biases the arms to a roller-capture position in which base portions of the arms separate. Pivoting the links to a roller release position forces the base portion of the arms to move together against the biasing force of the spring, thereby releasing the roller cover.

These and other features and advantages of this invention are described in, or are apparent from, the following detailed description of various exemplary embodiments of the systems and methods according to this invention.

BRIEF DESCRIPTION OF THE DRAWINGS

The above mentioned and other features of this invention will become more apparent and the invention itself will be better understood by reference to the following description of embodiments of the invention taken in conjunction with the accompanying drawings, wherein.

Corresponding reference characters indicate corresponding parts throughout the views of the drawings.

DETAILED DESCRIPTION OF EXEMPLARY EMBODIMENTS

The invention will now be described in the following detailed description with reference to the drawings, wherein preferred embodiments are described in detail to enable practice of the invention. Although the invention is described with reference to these specific preferred embodiments, it will be understood that the invention is not limited to these preferred embodiments. But to the contrary, the invention includes numerous alternatives, modifications and equivalents as will become apparent from consideration of the following detailed description.

Figure 1:
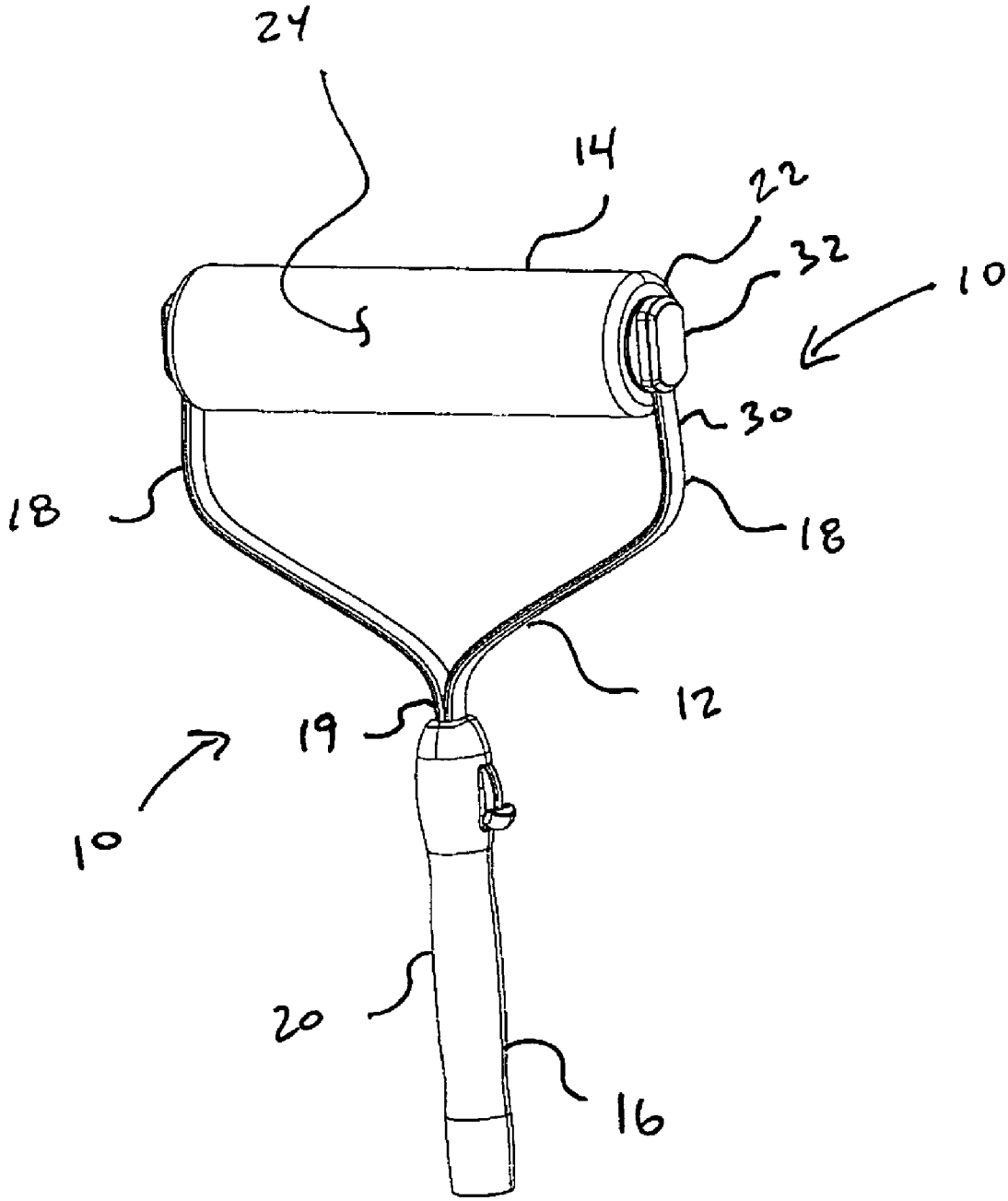
FIG. 1 is a perspective view of a paint roller.

Referring now to FIG. 1, the invention is directed to a paint roller tool generally designated by the reference number 10 for use in applying paint or other product to a work surface. The paint roller 10 includes a frame 12 and a roller cover 14 rotatably coupled thereto. The frame 12 has a hand grip 16 useful for griping the paint roller 10 and a pair of arms 18 that diverge outwardly from one another such that the frame 12 has a generally Y-shape for rotatably receiving the ends of the roller cover 14. By generally Y-shaped it is meant that the frame 12 has a base portion 19 that is received in the hand grip 16 and two spaced apart arms 18 that capture the ends of the roller cover 14 and one skilled in the art will understand that this is not to be construed narrowly as a single specific shape.

In one embodiment, the hand grip 16 has a soft ergonomic grip overmold 20 to improve comfort while in use. Alternatively, other hand grips known in the art may be used without departing from the scope of the invention. Desirably, a telescoping handle (not shown) slides out of or can be attached to the hand grip 16 to add to the hand grip length for hard to reach areas. While materials for the frame 12 are not intended to be limiting, preferably the frame 12 is manufactured of a material such as aluminum or stainless tubing, fiberglass, or a synthetic polymeric material, such as nylon, polyethylene or other molded plastic for providing a light weight yet durable paint roller 10.

The roller cover 14 is desirably a standard 9-inch (23 cm) roller cover that is commonly used with conventional paint rollers having an inner tube 22 with a 1.5-inch (3.8 cm) inside diameter and an outer circumferential surface material 24 for carrying paint or other material to be applied to the work surface. As is known, the surface material 24 is made of sponge, cotton, synthetic fibers, wool, or the like, and is highly capable of absorbing the paint or other liquid to be applied. However, the frame 12 may be sized so as to receive roller covers 14 with other widths, such as 3 inches, 6 inches, 7 inches, 12 inches, or 18 inches, and other diameters without departing from the scope of the invention.

Figure 2:
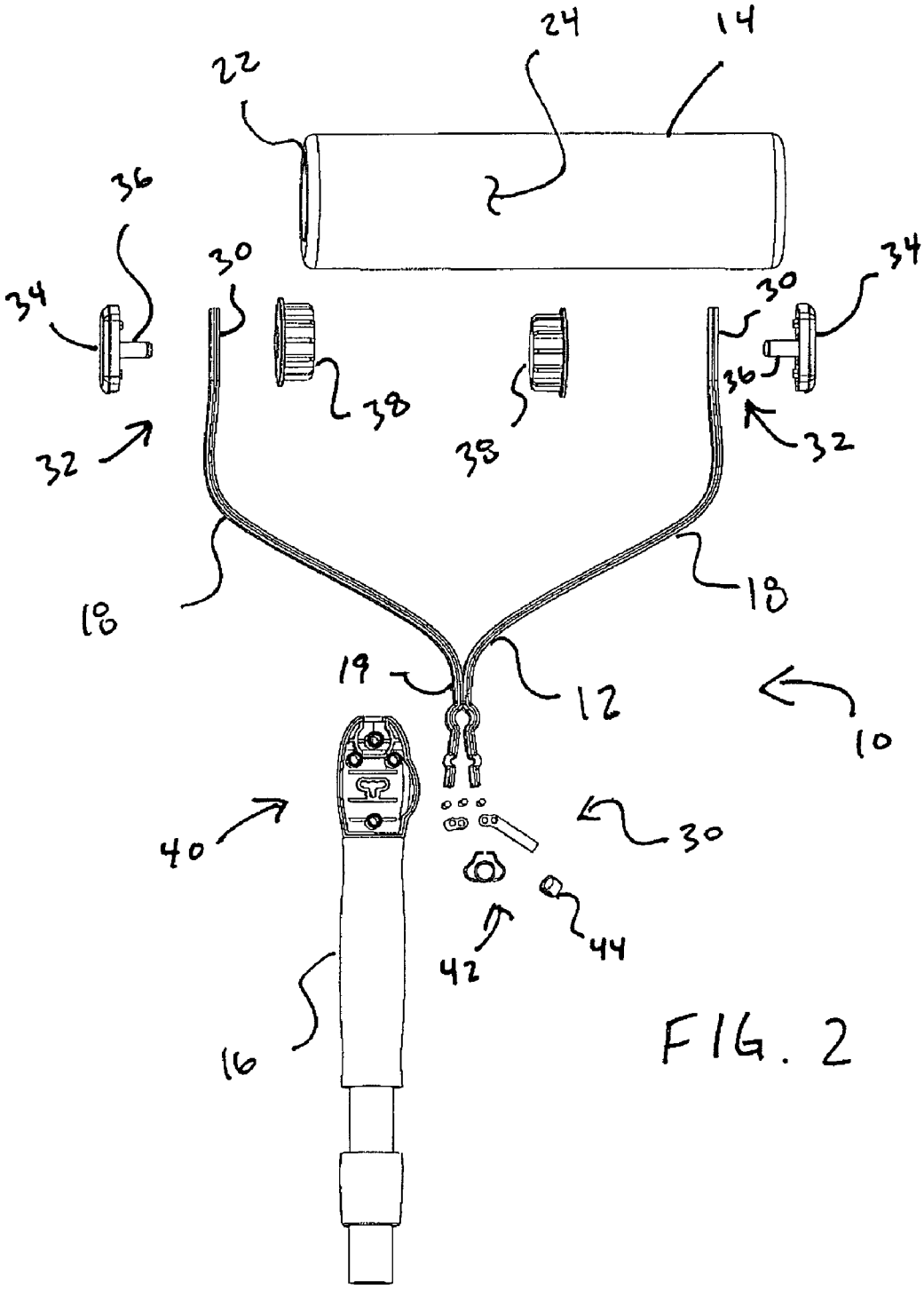
FIG. 2 is an exploded view of the paint roller of FIG. 1.

Turning now to the exploded view of FIG. 2, in one embodiment the roller cover 14 is removably mounted at distal ends 30 of the arms 18 of the frame 12 with a pair of roller cover mounting mechanisms 32. Each roller cover mounting mechanism 32 has an end cap 34 with a stub axle 36 extending from an inward facing portion thereof. The stub axle 36 passes through an opening (not shown) in the arm 18 and is then inserted into a centrally disposed hole in a mounting cone 38 to rotatably attach the roller cover mounting mechanism 32 to the arm 18. The mounting cone 38 is configured to be received in the inner tube 22 of the roller cover 14. However, one skilled in the art will recognize that other means for rotatably connecting the mounting cones 38 to the arms 18 of the roller 10 may be incorporated using sound engineering judgment without departing from the scope of the invention.

Figure 3:
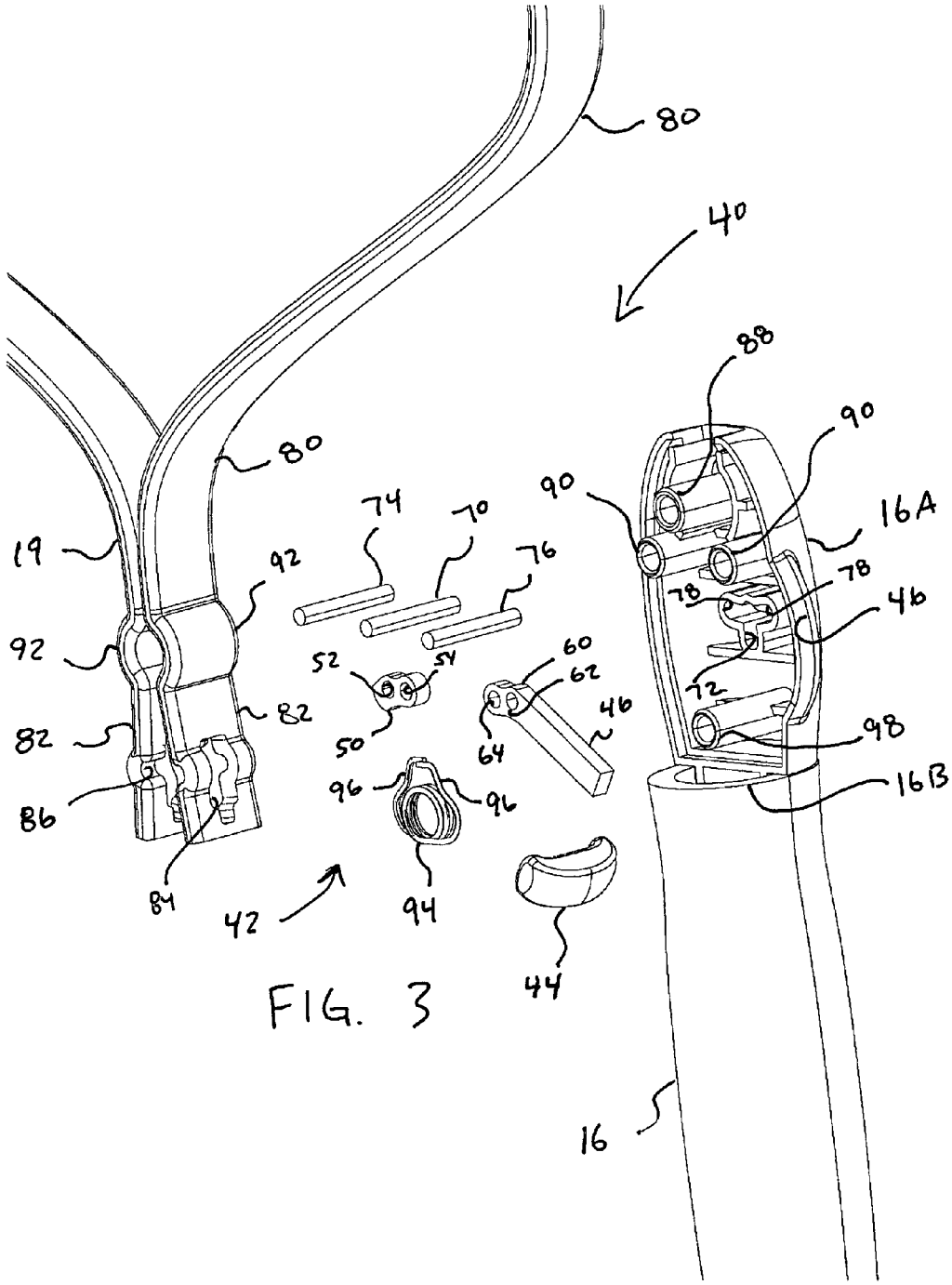
FIG. 3 is an enlarged exploded perspective view of a portion of the paint roller of FIG. 1 illustrating the pivoting arms of the roller frame that provides a quick-release feature.

Turning now to the enlarged view of FIG. 3, as is known in the art the hand grip 16 is desirably formed from two half shells 16A, 16B that are joined together by any known means such as by welding, adhesive, fasteners, etc. According to the invention, the paint roller 10 has a "hands-free" quick-release capture mechanism 40 that quickly detaches the roller cover 14 from the frame 12. In the illustrated embodiment, the capture mechanism 40 comprises a pivoting linkage system 42 situated between the half shells 16A, 16B and a roller-release button 44, which, when actuated such as by sliding it along an opening 46 formed in the hand grip 16, causes the pivoting linkage system 42 to cause the distal ends 30 of the arms 18 to pivot outwardly to automatically release the roller cover 14 and thereby at least partially decouple the roller cover 14 from the frame 12. The pivoting linkage system 42 is desirably positioned between the half shells 16A, 16B of the hand grip 16 and is substantially contained within the joined half shells 16A, 16B with the exception of the roller-release button 44 and a connecting leg 46 to which the roller release button 44 is attached so that the pivoting linkage system 42 remains substantially free of paint during use.

Actuation of this quick-release capture mechanism 40 automatically releases roller cover 14 from the frame 12 thus eliminating the need for the user to handle the paint-saturated roller cover 14 when removing the roller cover 14 from the frame 12. The terms "automatic", "hands-free" and "quick-release" as used herein with respect to the capture mechanism 40 mean that the decoupling of the paint roller cover 14 from the frame 12 occurs without requiring the user to apply a manual force directly to the paint roller cover 14. In other words, although a force is required to be applied to the capture mechanism 40 to initiate the decoupling process, the actual force decoupling the roller cover 14 from the frame 12 is provided by means other than manual force applied by the user to the roller cover 14 itself, as will be set forth more fully below.

The pivoting linkage system 42 includes a first link 50 having an outward hole 52 and an inward hole 54 and a second link 60 also having an outward hole 62 and an inward hole 64. The links 50, 60 are substantially similar except that the second link 60 is connected to the connecting leg 46 and roller release button 44 used to actuate the pivoting linkage system 42. The first and second links 50, 60 are positioned in an overlapping manner such that the inward holes 54, 64 in the two links 50, 60 align. A connecting rod 70 passes through the inward holes 54, 64 of the two links 50, 60 with an end of the connecting rod 70 protruding from the links 50, 60 and being slideably positioned in a slot 72 formed in the hand grip 16. Pivot axles 74, 76 are received in respective outward holes 52, 62 of the two links 50, 60 with ends of the pivot axles 74, 76 protruding from the links 50, 60 and positioned in extensions 78 of the slot 72 formed in the hand grip 16. The pivot axles 74, 76 are constrained in the extensions 78 of the slot 72 such that each link 50, 60 may pivot about its respective pivot axle 72, 74 as the connecting rod 70 slides up or down in the slot 72.

Each arm 18 has bends 80 formed therein such that the base portion 19 of the frame 12 comprises individual base portions 82 of each arm 18 that are brought into the hand grip 16. Thus, the base portion 82 of a first arm 18 is substantially adjacent to the base portion 82 of the opposing arm 18. The outer end of each link 50, 60 sits in a groove 84 formed in the base portion 82 of its respective arm 18. Generally rounded channels 86 are also formed in the base portions 82 of the arms 18 to receive the pivoting axles 74, 76. A center boss 88 and two side bosses 90 are formed in the hand grip 16 in a generally triangular pattern. The base portion 82 of each arm 18 passes between the center boss 88 and a respective side boss 90. A dimple 92 is formed in each arm 18 such that the two arms substantially encircle the center boss 88 when the base portions 82 of the arms 18 are brought substantially together.

Figure 4:
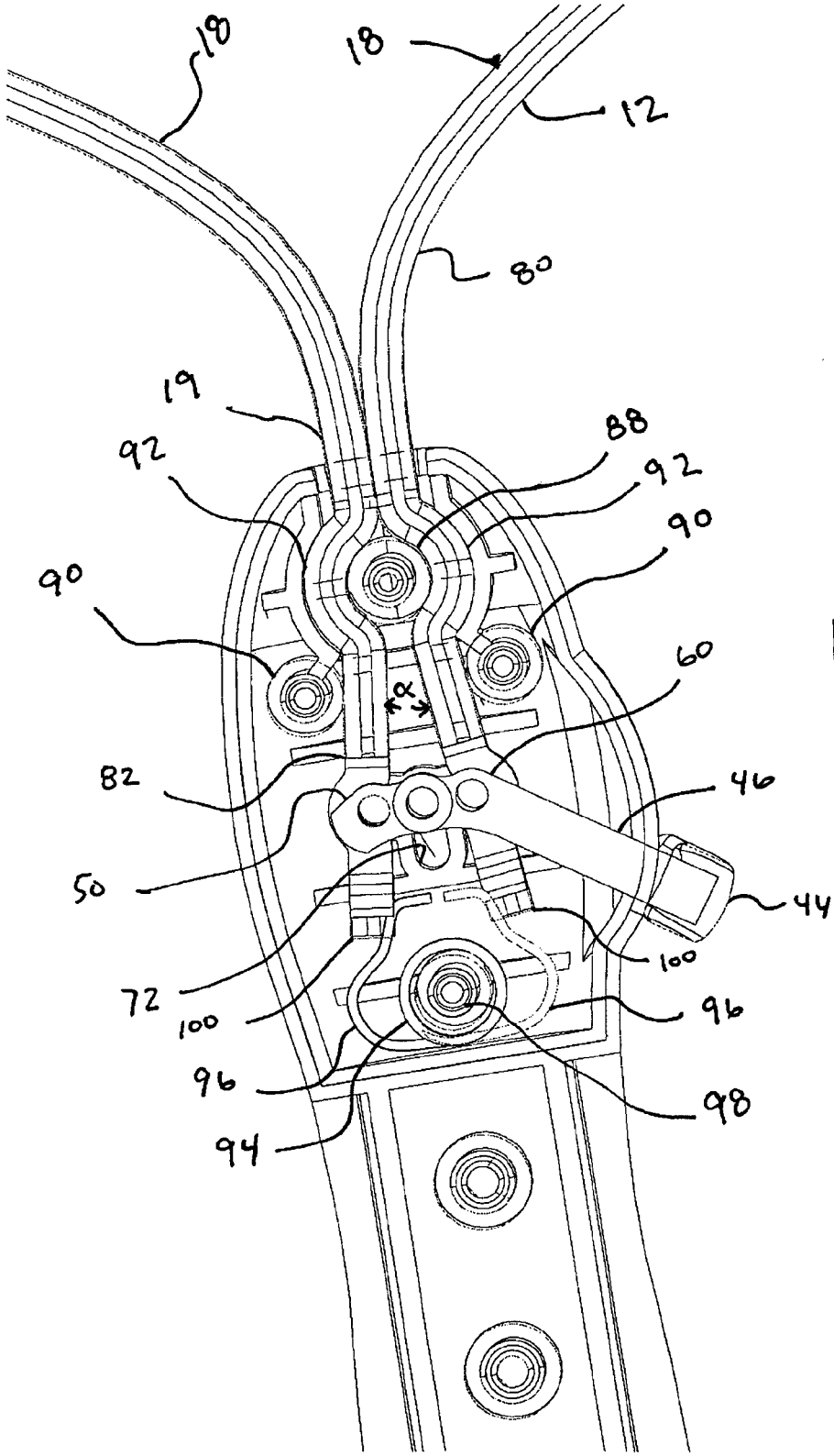
FIG. 4 is a cutaway view of a portion of the paint roller of FIG. 1.

A torsion spring 94 with protruding legs 96 is positioned on a post 98 formed in the hand grip 16. The legs 96 of the spring 94 engage proximal ends 100 of the base portion 82 of the arms 18 and act to bias the base portion of the arms such that the proximal ends 100 are separated. This biasing force of the spring 94 and interaction of the arms 18 with the center boss 88 and side bosses 90 cause the distal ends 30 of the arms 18 to move together such that the roller cover 14 is captured between the arms and rotatably held on the frame 12 by the two roller mounting cones 38 such as for normal use when painting. Thus, the spring 94 biases the arms 18 to a roller-capture position (as illustrated in FIG. 4) such that the base portions 82 of the arms 18 separate at an angle $\alpha$ desirably between about 5 and about 20 degrees.

When it is desired to remove the roller cover 14 after use or install a new roller cover 14 on the frame 12, the operator actuates the roller-release button 44 by moving it along the opening 46 in the hand grip 16 such that the leg 46 causes the second link 60 to pivot about its pivoting axle 76. This causes the connecting rod 70 positioned in the inward hole 64 in the second link 60 to slide in the slot 72 toward the lower end of the slot. Sliding of the connecting rod 70 in the slot 72 causes the first link 50 to pivot about its pivot axle 74. Pivoting of the links 50, 60 forces the base portion 82 of the arms 18 to move together against the biasing force of the spring 94, reducing the angle $\alpha$ separating the base portions 82.

Movement of the base portions 82 of the arms 18 together causes the arms to pivot about the center boss 88, thereby causing the distal ends 30 of the arms 18 to open or separate. Desirably, the arms 18 have a generally rectangular cross section with the broad face of the rectangular-shape in contact above the dimple 92 and in bend 80 as the arms 18 pivot. This causes the mounting cones 38 to be withdrawn from the inner tube 22 of the roller cover 14, thereby releasing the roller cover 14 from the frame 12. Therefore, sliding the roller-release button 44 automatically releases the roller cover 14 from the frame 12. It is conceived that the roller cover 14 could stick to the mounting cones 38 on the arm 18 because of dried paint such that small taps on the roller cover 14 or frame 12 may be necessary to dislodge the roller cover. It is clear that this may be done without having to touch the roller cover 14 with ones hands and does not defeat the quick-release or hands free function of the capture mechanism 40. The roller release button 44 is shown connected to the leg 46 to form a slide trigger that pivots the links 50, 60 about the pivot axles 74, 76. However, one skilled in the art will understand that other mechanisms for pivoting the links 50, 60 may be used using sound engineering judgment without departing from the scope of the invention.

In one embodiment, the roller cover 14 is received on the cones 38 by a slip fit so that the roller cover 14 can easily slide off the cones 38 when the pivoting linkage system 42 is pivoted to enhance the quick-release feature of the roller 10. The roller cover 14 may freely spin on the cones 38 when the cones are in the roller-capture position such that the roller cover 14 still rotates with respect to the frame 12 in the case dried paint makes it difficult for the cones 38 to spin relative the frame 12. Alternately, the roller cover 14 may be received on the cones 38 with a slight friction fit. The paint roller 10 is ready to use with the roller cover 14 and the mounting cones 38 rotating with respect to the frame 12.

Importantly, it is desirable that the roller-release button 44 be a sufficient distance from the roller cover 14 to reduce the likelihood that the roller-release button 44 will become covered with paint. Paint rollers 10 are typically used by dipping the roller cover 14 into a tray filled with the paint to be applied to the work surface. As such, the distal ends 30 of the arms 18 also may also come in contact with and be covered by the paint from the tray. Thus, the roller-release button 44 is desirably on the hand grip 16 and offset from the axis of the roller cover 14 in a location that will not routinely come in contact with the paint.

While this invention has been described in conjunction with the specific embodiments described above, it is evident that many alternatives, combinations, modifications and variations are apparent to those skilled in the art. Accordingly, the preferred embodiments of this invention, as set forth above are intended to be illustrative only, and not in a limiting sense. Various changes can be made without departing from the spirit and scope of this invention.

What is claimed is:

1. A paint roller comprising:

a tube-shaped roller cover;

a hand grip;

a frame comprising a pair of arms having base portions received in the hand grip, said arms diverging outwardly to form a Y-shaped frame, wherein distal ends of said arms comprise mounting cones configured to receive opposing ends of the tube-shaped roller cover in a rotatable manner with respect to the frame;

a roller capture mechanism pivoting the arms between a roller-capture position in which the roller cover is captured between the arms and a roller-release position in which the roller cover is decoupled from the arms; and a roller-release button configured to actuate the capture mechanism to pivot the arms between their roller-capture positions and their roller-release positions.

2. The paint roller of claim 1 wherein the capture mechanism is a quick-release capture mechanism with a pivoting linkage system to automatically release the roller cover such that decoupling of the paint roller cover from the roller frame occurs without requiring a user to apply a manual force directly to the roller cover.

3. The paint roller of claim 1 wherein the capture mechanism comprises a pivoting first link and a pivoting second link, the roller release button being connected to the second link, wherein the first and second links are positioned in an overlapping manner and are connected with a connecting rod such that pivoting the second link with said roller-release button also causes said first link to pivot.

4. The paint roller of claim 3 wherein the connecting rod is slideably positioned in a slot formed in the hand grip.

5. The paint roller of claim 4 wherein the first link is pivotable about a first pivot axle and the second link is pivotable about a second pivot axle such that each link pivots about its respective pivot axle as the connecting rod slides up and down in the slot.

6. The paint roller of claim 5 wherein the first link has an outward hole and an inward hole and the second link also has an outward hole and an inward hole, wherein the first and second links are positioned in an overlapping manner such that the inward holes in the two links align and the connecting rod passes through the inward holes of the two links with an end of the connecting rod protruding from the links and being slideably positioned in the slot and the pivot axles are received in respective outward holes of the two links with ends of the pivot axles protruding from the links are constrained such that each link pivots about its respective pivot axle as the connecting rod slides up or down in the slot.

7. The paint roller of claim 5 further comprising a torsion spring with protruding legs, wherein the legs of the spring engage proximal ends of the base portion of the arms and act to bias the base portion of the arms such that the proximal ends are separated.

8. The paint roller of claim 7 further wherein the outer end of each link sits in a groove formed in the base portion of its respective arm, and wherein generally rounded channels are also formed in the base portions of the arms to receive the pivoting axles.

9. The paint roller of claim 8 further comprising a center boss and two side bosses are formed in the hand grip in a generally triangular pattern, the base portion of each arm passing between the center boss and a respective side boss, wherein the biasing force of the spring and interaction of the arms with the center boss and side bosses cause the distal ends of the arms to move together such that the roller cover is captured between the arms and rotatably held on the frame by the roller mounting cones such as for normal use when painting.

10. The paint roller of claim 9 wherein the spring biases the arms to a roller-capture position in which the base portions of the arms separate at an angle $\alpha$ of between about 5 and about 20 degrees, and pivoting of the links to roller release positions forces the base portion of the arms to move together against the biasing force of the spring, thereby reducing the angle $\alpha$ separating the base portions.

11. The paint roller of claim 5 wherein the arms have a rectangular cross-section.

12. The paint roller of claim 1 wherein the roller cover is a standard 9-inch (23 cm) roller cover.

* * * * *